US006237974B1

(12) United States Patent
Chisholm

(10) Patent No.: US 6,237,974 B1
(45) Date of Patent: May 29, 2001

(54) TOOL FOR MOVING DEBRIS WITHIN A GUTTER

(76) Inventor: Bruce Chisholm, P.O. Box 25813, Portland, OR (US) 97298-0094

( * ) Notice: Subject to any disclaimer, the term of this patent is extended or adjusted under 35 U.S.C. 154(b) by 0 days.

(21) Appl. No.: 09/457,044

(22) Filed: Dec. 7, 1999

(51) Int. Cl.[7] ..... E04D 13/076

(52) U.S. Cl. ..... 294/55; 15/236.04

(58) Field of Search ..... 294/7, 19.1, 22–24, 294/49, 55, 57; 15/104.05, 104.068, 104.16, 236.01, 236.04, 236.05, 236.07, 236.09; 239/532; 401/137, 139, 261; 403/109.3, 109.8, 322, 329

(56) References Cited

U.S. PATENT DOCUMENTS 2,291,015 * 7/1942 Anderson ..... 15/263.05 X
2,299,418 * 10/1942 Thomas ..... 294/55
2,810,144 * 10/1957 McIntosh ..... 15/236.05 X
2,957,192 * 10/1960 Faughnder ..... 15/236.07
3,004,341 * 10/1961 Carroll et al. ..... 294/7 X
3,789,450 * 2/1974 Mozdenski et al. ..... 15/236.05 X
3,858,267 * 1/1975 Swannie ..... 294/19.1 X
4,247,216 * 1/1981 Pansini ..... 403/109.3
4,542,553 * 9/1985 Cary ..... 294/19.1 X
5,033,156 * 7/1991 Stewart ..... 15/236.05
5,288,118 * 2/1994 Hartselle ..... 294/19.1

* cited by examiner

*Primary Examiner*—Johnny D. Cherry
(74) *Attorney, Agent, or Firm*—Chernoff, Vilhauer, McClung, Stenzel

(57) ABSTRACT

A tool for moving debris within an elongate gutter having a lower surface and an upright surface. The tool includes an elongate member having a major portion which is substantially straight and an end portion with a substantially straight first edge at an acute angular relationship to a substantially straight second edge. The orientation of the end portion with respect to the elongate member is such that the first edge is in face-to-face abutment with the upright surface and the second edge is in face-to-face abutment with the lower surface, when the major portion of the elongate member is in a substantially parallel orientation with the gutter.

12 Claims, 4 Drawing Sheets

TOOL FOR MOVING DEBRIS WITHIN A GUTTER

BACKGROUND OF THE INVENTION

The present invention relates to a tool for moving debris within a gutter for cleaning the gutter of leaves, roofing material granules, dirt, and other accumulations.

It is at least an annual chore in most locations where there are trees of any size to remove the leaves and other debris that accumulates in gutters of the type commonly used on personal residences. This material must be removed in order to permit the proper drainage of the water received from the adjacent roof in order to prevent the gutter from overflowing. Further, with many gutters, particularly steel gutters, it is desirable that the drainage be free or unblocked in order to eliminate rusting.

Gutters are normally maintained in position by using gutter spikes or clips which are secured to the roof. In either case, these clips and spikes interfere with the cleaning process. Various tools are used by home owners in this generally disagreeable task of removing debris, such as trowels, spatulas, and the like.

In order to successfully clear the gutters, it is usually necessary to either approach the gutter from the roof, from the ground, or from a ladder. In any case, the tool needs to get over the top of and into the gutter in order to successfully reach the debris and to be sure that the bottom of the gutter is clear. Further, it is desirable that the user view the tool as it is moved along the gutter. In this regard, some attempts have been made to provide tools which can be used by the home owner while he is on the ground adjacent the side of the home. These tools include elongated links of tubes or the like and require operation of the tool from the end of a tool handle while preventing observation of the gutter itself. Such tools are cumbersome because of their length.

Cary, U.S. Pat. No. 4,542,553, discloses a tool for cleaning gutters which includes a singular rod-like member to which is attached a plate adjacent one end and a handle adjacent the other end. The configuration is such that the plate can be scrapped along a gutter by a user without scraping his finger. The tool is used by simply pressing it along in the gutter so as to scrape the debris along ahead of it. To facilitate this pushing of debris, a rod-like member interconnects the blade and the handle, where the first section of the rod is substantially perpendicular to the flat face of the plate. The rod further includes a second section which extends upwardly vertically from the first section, and a third section extending substantially in a plane parallel to the horizontal plane of the first section and substantially normal to the flat face of the plate. The plate is rectangular with ninety degree angles thereto which is suitable for matching the shape of the bottom and sides of the gutter with the first section of the rod being substantially perpendicular to the plate. Accordingly, the tool is suitable to push debris a substantial distance under clips or gutter spikes. Unfortunately, it may be difficult to push a large pile of debris under a clip or gutter spike if the debris presses against the clip or gutter spike. In addition, the sharp angular bends of the rod make it prone to bending under pressure, thereby frustrating the user.

Dilley, U.S. Pat. No. 4,194,780, discloses a gutter cleaning tool including a pole handle, to each end of which is attached a simple tool consisting of two arms mounted at right angles to the handle and 180 degrees apart. On each end of the arm is a paddle shaped roughly like the bottom of the gutter. About six inches from the pole, one of the arms is offset some three inches toward the user. In operation, the paddle on the straight arm pulls the leaves down the gutter until it reaches a cross-strut. The user then rotates the handle 180 degrees permitting the offset arm and the smaller paddle to pull the leaves under the cross strut. The user then rotates the handle back to its original position and inserts the paddle of the straight arm into the gutter on the near side of the cross-strut but behind the pile of debris. This process is repeated until the debris has been brought to the user and lifted from the gutter. Unfortunately, the tool disclosed by Dilley is complicated and relatively expensive. In addition, the paddles are shaped roughly like the bottom of the gutter, having perpendicular elongate edges, which limits their usefulness with gutters having different profiles. Cary, U.S. Pat. No. 4,542,553; Despain et al., U.S. Pat. No. 3,626,542; Dilley, U.S. Pat. No. 4,194,780; and Kreiser, U.S. Pat. No. 5,435,612 disclose several different gutter profiles.

What is desired, therefore, is a gutter cleaning tool that is suitable to pull debris toward a user from a distance, while avoiding clips and gutter spikes. The gutter cleaning tool should be designed such that it may effectively accommodate different gutter profiles.

BRIEF SUMMARY OF THE INVENTION

The present invention overcomes the aforementioned drawbacks of the prior art by providing a tool for moving debris within an elongate gutter having a lower surface and an upright surface. The tool includes an elongate member having a major portion which is substantially straight and an end portion with a substantially straight first edge, and a substantially straight second edge. The first and second edges are oriented at an acute angle with respect to one another. The orientation of the end portion with respect to the elongate member is such that the first edge is in face-to-face abutment with the upright surface of the gutter and the second edge is in face-to-face abutment with the lower surface of the gutter, when the major portion of the elongate member is in a substantially parallel orientation with the gutter.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figures 1, 2, 3:
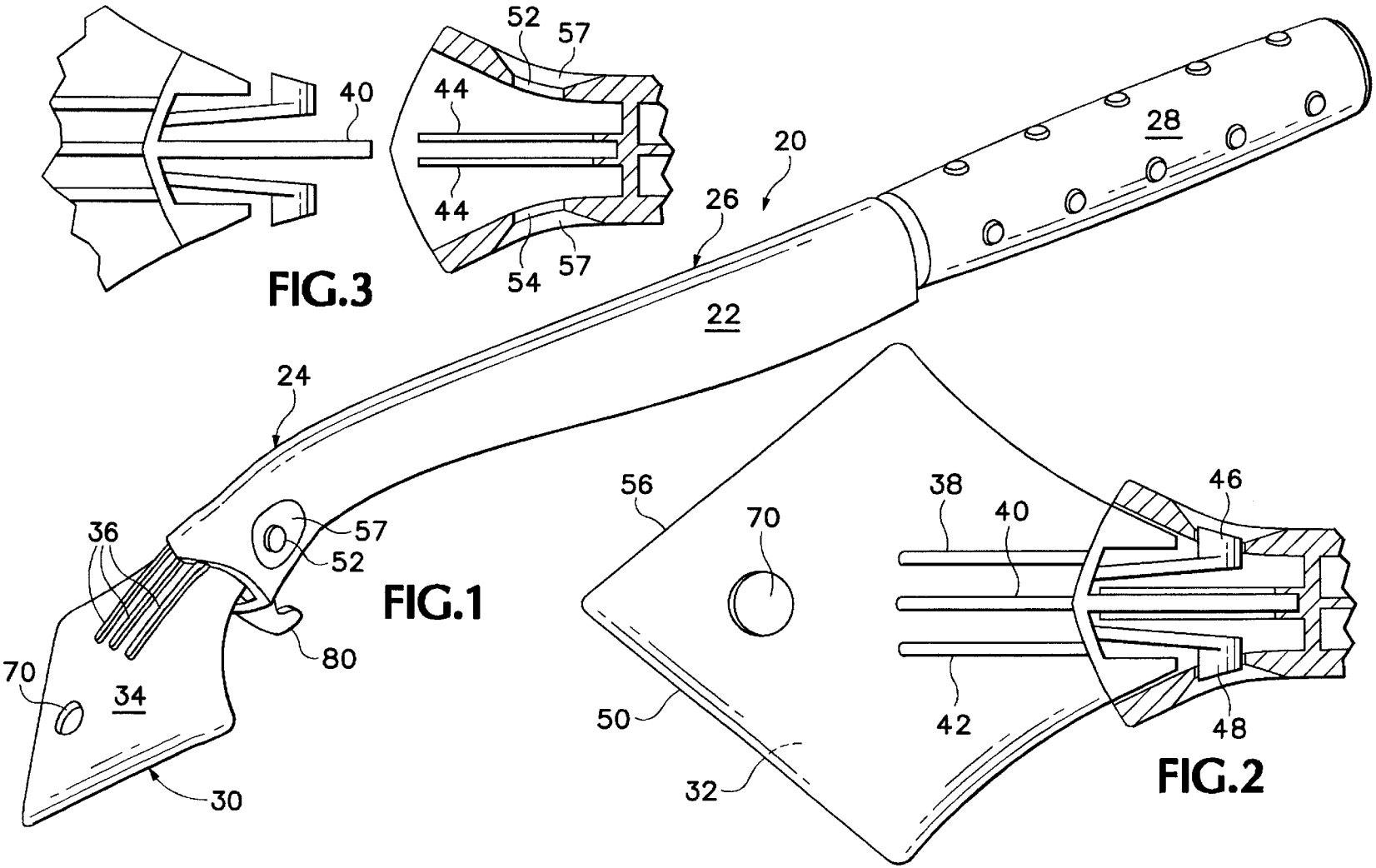
FIG. 1 is a pictorial view of an exemplary embodiment of a gutter tool of the present invention.
FIG. 2 is a partial plan view of the end portion of the tool of FIG. 1 with the scoop attached to the body.
FIG. 3 is a partial view of the end portion of the tool of FIG. 1 with the scoop detached from the body.

Referring to FIG. 1, an exemplary gutter cleaning tool 20 is shown. The tool 20 includes an elongate body 22. The elongate body includes an arched portion 24 and a substantially straight portion 26. The tool 20 includes an elongate handle 28 which is preferably detachably engageable with the elongate body 22, such as engaging the end portion of the handle 28 within an opening in the end of the elongate body 22. The handle 28 may include telescoping portions, if desired, to provide additional length to the tool 20. Alternatively, the handle 28 may be non-detachable or formed integral with the body 22. The handle 28 may include a textured surface for ease of handling by the user, if desired. The body 22 and handle 28 are preferably hollow in nature. A major portion of the elongate body 22, elongate handle 28, or the combination thereof, is preferably substantially straight. The length of the combination of the body 22 and handle 28 is preferably suitable for a user on a ladder to clean a significant portion of a gutter, as described later, without being unduly difficult to handle.

Figures 4, 5:
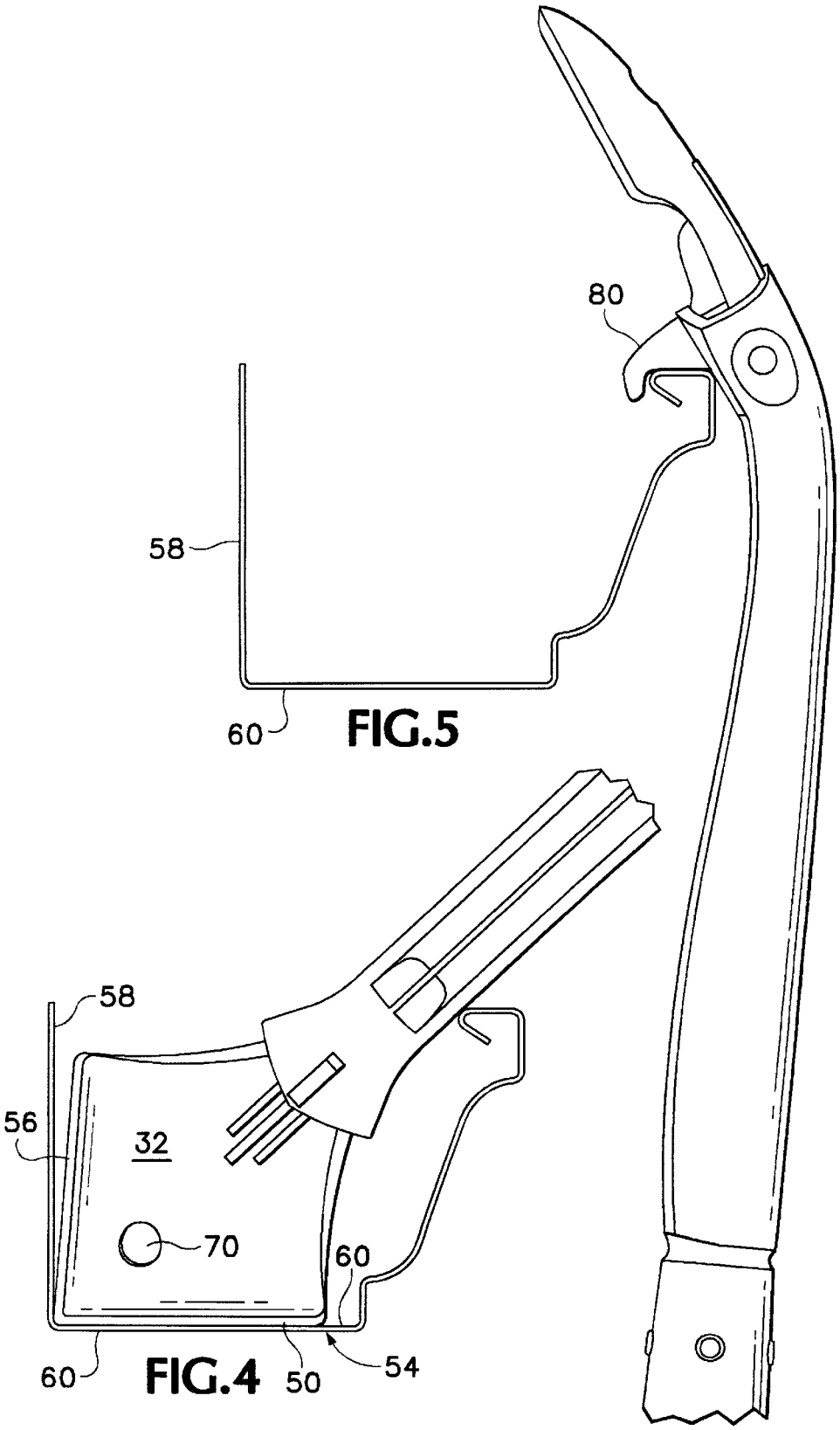
FIG. 4 is a partial end elevation view of the tool of FIG. 1 located within a gutter.
FIG. 5 is a partial view of the tool of FIG. 1 hanging from a gutter.
Figure 6:
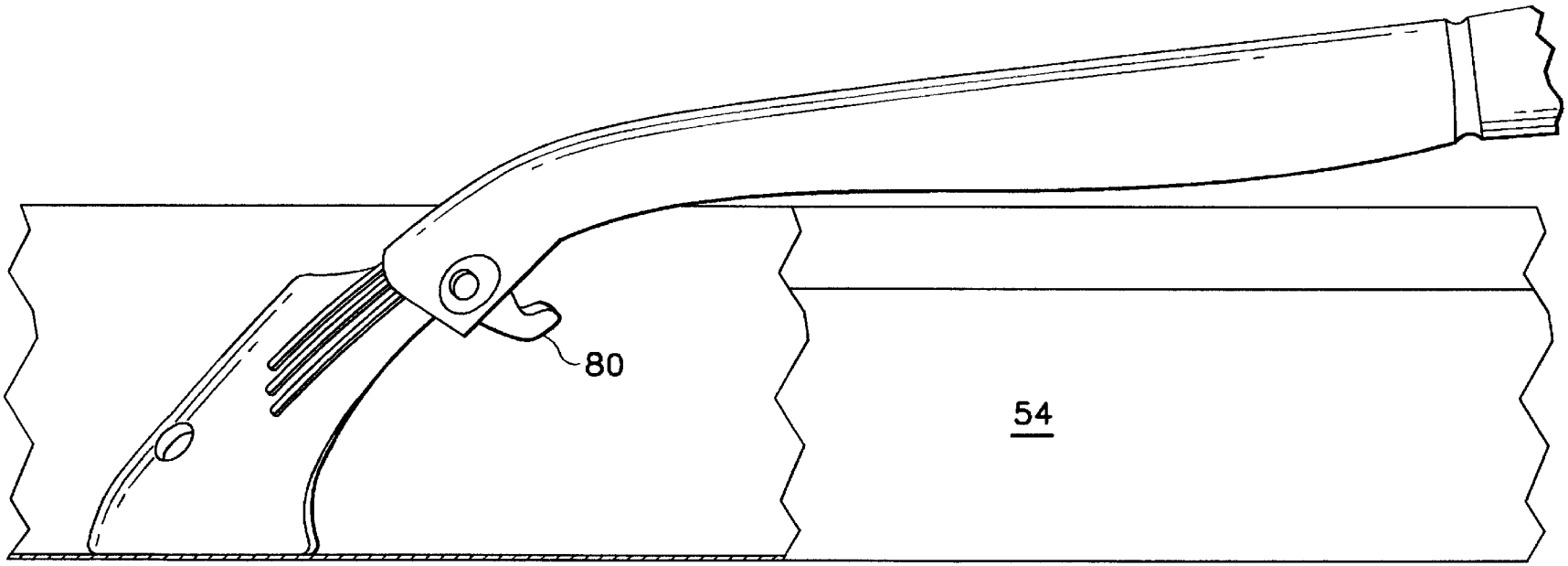
FIG. 6 is a partial side elevation view of the tool of FIG. 1 located within a gutter.
Figure 7:
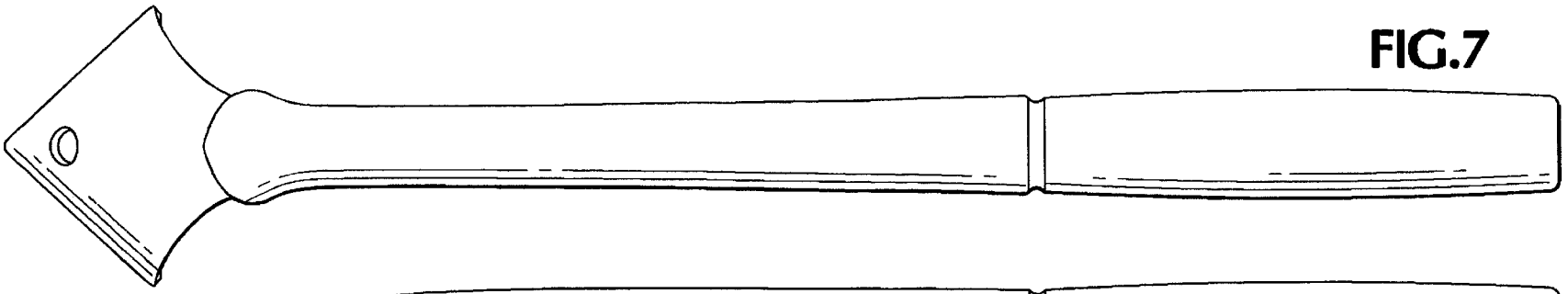
FIG. 7 is a plan view of the tool of FIG. 1.
Figure 8:
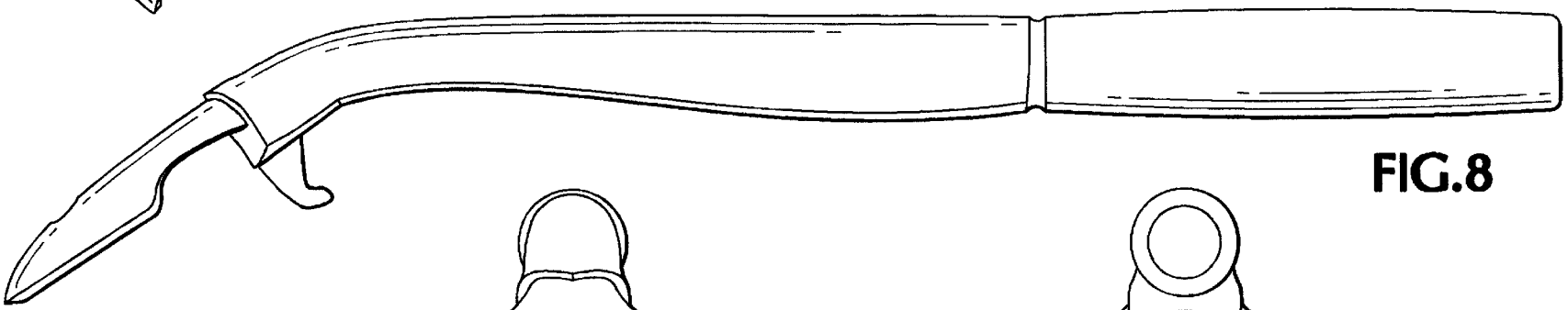
FIG. 8 is a left side elevation view of the tool with the right side being identical thereto.
Figure 10:
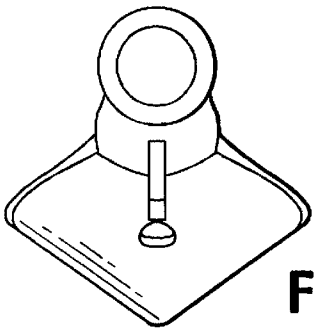
FIG. 10 is a rear elevation view of the tool of FIG. 1.
Figure 9:
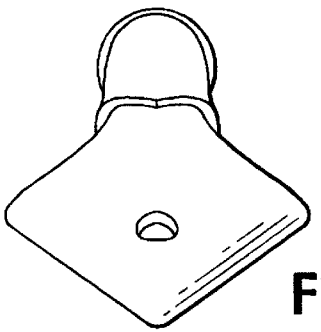
FIG. 9 is a front elevation view of the tool.
Figure 11:
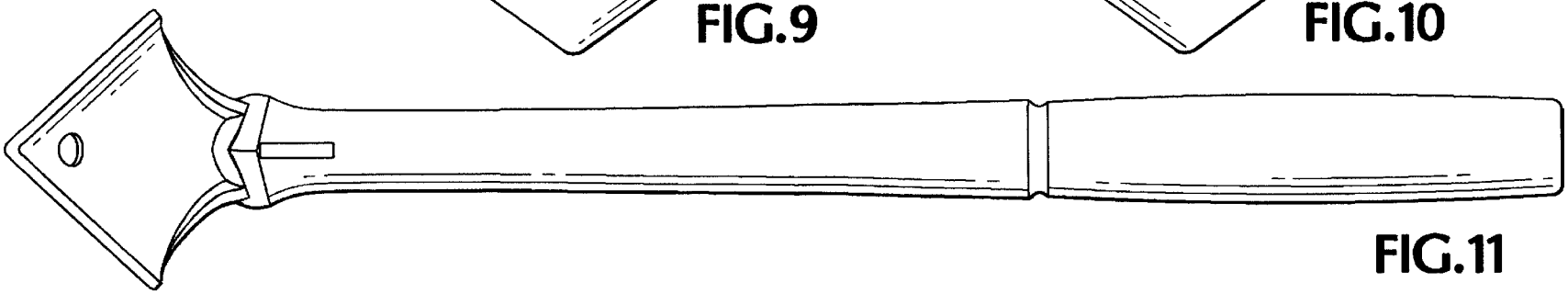
FIG. 11 is a bottom plan view of the tool of FIG. 1.

A scoop 30 is preferably detachably engageable with the body 22. Alternatively, the scoop 30 may be integral with the body 20, if desired. The scoop 30 includes a concave surface 32 suitable to retain debris therein. Referring to FIGS. 2, 3, and 4, a convex outer surface 34 of the scoop 30 includes a set of three ribs 36. The concave inner surface 32 includes a set of three ribs 38, 40, and 42. The rib 40 slidably engages between a pair of ribs 44 on the lower surface of the body 22 and a pair of ribs (not shown) on the upper surface of the body 22. The rib 40 and engaging ribs of the body retain the scoop 30 in proper alignment with the body 22. The ribs 38 and 42 include a pair of tabs 46 and 48, respectively. The ribs 38 and 42 are resiliently bendable for engagement and release of the tabs 46 and 48 with a set of openings 52 and 54 defined by the body 22 when the scoop 30 is engaged therewith. The body 22 defines a pair of depressions 57 therein to assist in releasing the tabs from the openings for disengaging the scoop 30 from the body 22 by simultaneously pressing on the tabs 46 and 48. The depressions also help maintain the tabs 46 and 48 in a location not likely to be inadvertently bumped thereby disengaging the scoop 30 from the tool 20.

Referring also to FIG. 4, the right edge 56 of the scoop 30 is sized to be narrower than a standard gutter 54 so that when using the tool with unusually narrow gutters the same scoop 30 will be usable. Alternatively, the detachable engagement of the scoop 30 permits the use of different shaped and sized scoops. When the scoop 30 is oriented in an upright and generally perpendicular relationship to the length of the gutter 54, the left edge 50 of the scoop 30 will not be in face-to-face abutment with the upright surface 58 of the gutter 54. In this position, likewise the body 22 will extend away from the gutter 54 making use of the tool 20 exceedingly difficult. The present inventor came to the realization that by selecting the proper acute angle between the left edge 50 and the right edge 56, together with the orientation of the body 22 with respect to the scoop 30, a major portion of the body 22, handle 28, or the combination thereof, can be placed in a substantially parallel relationship to the length of the gutter 54 and the right edge 56 will be in a face-to-face abutment with the upright surface 58 of the gutter 54, and the left edge 50 will be in a face-to-face abutment with the lower surface 60 of the gutter 54. The angular relationship between the right and left edges likewise permits the tool 20 to accommodate different gutter profiles by changing the pitch of the handle 28 and body 22 with respect to the gutter 54 during use. At slightly different pitches, the body 22 and handle 28 are still in a substantially parallel orientation with the gutter (axial length thereof), but the angle of the edges 58, 60 changes relating to the gutter.

The body 22 of the tool 20 is above the clips or gutter pins so that movement of the debris within the gutter may be done by pulling on the tool 20 through the gutter 54. When reaching a clip or gutter pin, the scoop 30 is raised out of the gutter 54 and the scoop is repositioned under the clip or gutter pin to grasp the debris and move it past the clip or gutter pin. In this manner, the debris may be effectively moved along the gutter from a distant point to a user on a ladder.

The scoop 30 includes an opening 70 therethrough so that the tool 20 may be stored by hanging from a nail when not in use. Referring to FIG. 5, the body 22 also includes a hanger 80 to support the tool 20 in a generally vertical orientation when supported by the top of the gutter 54.

FIGS. 7–11 illustrate different views of the tool 20 with some of the unnecessary elements removed.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A tool for moving debris within an elongate gutter having an open top, and a planer bottom surface and a side surface which are oriented with respect to one another at an angle which is at least 90°, said tool comprising:

(a) an elongate body having a major portion which is substantially straight along an elongate axis;

(b) a scoop with a substantially straight first edge and a substantially straight second edge, said first and second edges being adjacent and oriented at an acute angle with respect to one another; and (c) said scoop being oriented at an obtuse angle with respect to the elongate axis of said body, such that said first edge is in face-to-face abutment with said side surface and said second edge is in face-to-face abutment with said bottom surface, when said elongate axis is substantially parallel with the plane of said bottom surface and is located above said open top.

2. The tool of claim 1 wherein said scoop is detachably engageable with said body.

3. The tool of claim 2 wherein said scoop includes a pair of resiliently bendable ribs that engage said body.

4. The tool of claim 3, further comprising said body defining a pair of openings through which said ribs extend.

5. The tool of claim 4 where in said body defines a pair of recessed portions through which said ribs extend.

6. The tool of claim 3 further comprising a central rib disposed between said ribs.

7. The tool of claim 6, further comprising said body including a support structure for said central rib.

8. The tool of claim 1 wherein said body defines an opening therethrough.

9. The tool of claim 8 wherein said scoop is concave.

10. The tool of claim 9 wherein said first edge and second edge are straight.

11. The tool of claim 1 further comprising a hanger extending out from said body proximate said scoop to maintain said tool and a generally vertical orientation when said scoop is supported by a top portion of said gutter.

12. The tool of claim 11 wherein said edge is significantly shorter than the width of said bottom surface.

* * * * *